US010933274B2

(12) United States Patent
Negron

(10) Patent No.: US 10,933,274 B2
(45) Date of Patent: Mar. 2, 2021

(54) BRACE WITH STRAP DEVICE FOR EXERCISING STABILITY MUSCLES

(71) Applicant: Joseph Negron, Los Gatos, CA (US)

(72) Inventor: Joseph Negron, Los Gatos, CA (US)

( * ) Notice: Subject to any disclaimer, the term of this patent is extended or adjusted under 35 U.S.C. 154(b) by 101 days.

(21) Appl. No.: 15/927,704

(22) Filed: Mar. 21, 2018

(65) Prior Publication Data

US 2018/0272177 A1 Sep. 27, 2018

Related U.S. Application Data

(60) Provisional application No. 62/475,125, filed on Mar. 22, 2017.

(51) Int. Cl.

| | |
|---|---|
| ***A63B 21/00*** | (2006.01) |
| ***A63B 21/04*** | (2006.01) |
| ***A63B 23/035*** | (2006.01) |
| ***A63B 23/12*** | (2006.01) |
| ***A63B 21/068*** | (2006.01) |
| ***A63B 21/065*** | (2006.01) |
| ***A63B 21/072*** | (2006.01) |

(52) U.S. Cl.

CPC ..... *A63B 21/4017* (2015.10); *A63B 21/04* (2013.01); *A63B 21/065* (2013.01); *A63B 21/068* (2013.01); *A63B 21/4019* (2015.10); *A63B 21/4035* (2015.10); *A63B 21/4043* (2015.10); *A63B 23/03508* (2013.01); *A63B 23/12* (2013.01); *A63B 21/00069* (2013.01); *A63B 21/0726* (2013.01); *A63B 23/1218* (2013.01)

(58) Field of Classification Search

CPC . A63B 21/4017; A63B 21/065; A63B 21/068; A63B 21/4019; A63B 21/4043; A63B 21/04; A63B 21/4035; A63B 23/03508; A63B 23/12; A63B 21/0726; A63B 23/1218; A63B 21/00069; A63B 21/072–0726; A63B 21/40–4001; A63B 21/4011–4021; A63B 21/4025

See application file for complete search history.

(56) References Cited

U.S. PATENT DOCUMENTS

| | | | | |
|---|---|---|---|---|
| 4,253,660 A * | 3/1981 | Tiktin | A63B 21/065 2/160 |
| 4,368,883 A * | 1/1983 | Tiktin | A63B 21/065 2/162 |
| 4,756,527 A * | 7/1988 | Ledbetter | A63B 21/4035 482/139 |
| 4,846,464 A * | 7/1989 | Jorno | A63B 21/065 482/105 |
| 5,096,190 A * | 3/1992 | Montgomery | A63B 21/151 482/105 |

(Continued)

*Primary Examiner* — Andrew S Lo

(57) ABSTRACT

Embodiments of the present invention are drawn to an exercise device generally having a strap, a brace, and a ring. The brace includes four finger straps and a thumb strap for looping around and gripping a user's fingers and thumbs, respectively. When the exercise device is used while exercising, the force applied to the brace is evenly distributed to stretch and strengthen the user's hands. A key benefit of the exercise device is activating stabilizing muscles of the hands and arms. This promotes better form and technique during lifting, which translates into heavier weight lifted and fewer injuries.

18 Claims, 14 Drawing Sheets

(56) References Cited

U.S. PATENT DOCUMENTS 5,324,244 A * 6/1994 Miller ..... A63B 21/4021 482/106
5,613,923 A * 3/1997 Anliker ..... A63B 21/0004 482/44
5,634,213 A * 6/1997 Grover ..... A41D 19/01547 2/161.1
5,697,103 A * 12/1997 Wiggins ..... A41D 19/0048 2/159
5,746,685 A * 5/1998 Glaser ..... A63B 21/4019 2/161.1
5,809,570 A * 9/1998 Grover ..... A41D 19/01547 2/161.1
5,820,577 A * 10/1998 Taylor ..... A63B 21/0004 601/40
5,888,180 A * 3/1999 Dewberry ..... A63B 21/4019 2/161.1
5,898,944 A * 5/1999 Vrany ..... A41D 19/01547 2/160
5,993,362 A * 11/1999 Ghobadi ..... A63B 21/0004 482/121
5,997,494 A * 12/1999 Watkins ..... A61F 5/04 482/105
6,146,319 A * 11/2000 Tarail ..... A63B 21/065 2/161.1
6,168,556 B1 * 1/2001 Saavedra ..... A63B 21/4019 224/220
6,179,751 B1 * 1/2001 Clears ..... A63B 21/0004 482/44
6,393,615 B1 * 5/2002 Bedell ..... A41D 19/01547 2/159
D459,772 S * 7/2002 Meldeau ..... D21/662
6,553,574 B1 * 4/2003 Hall, Jr. ..... A63B 21/065 2/160
6,921,354 B1 7/2005 Shifferaw
8,312,567 B1 * 11/2012 Valle ..... A63B 21/065 2/161.1
8,403,818 B1 3/2013 Wilkinson et al.
9,061,173 B1 * 6/2015 Felkel ..... A63B 21/0557
9,573,015 B2 * 2/2017 Hall ..... A63B 21/0726
9,643,073 B1 * 5/2017 Pellegrino ..... A63B 71/141
10,245,460 B2 * 4/2019 Hetrick ..... A63B 21/4019
10,252,105 B2 * 4/2019 Dickens ..... A63B 21/0442
10,388,180 B1 * 8/2019 Dayan ..... A63B 21/02
2004/0152569 A1 * 8/2004 Lerner ..... A63B 21/0552 482/124
2005/0137064 A1 * 6/2005 Nothnagle ..... A63B 21/0726 482/108
2005/0227833 A1 * 10/2005 Wilkinson ..... A63B 21/0004 482/124
2005/0255973 A1 * 11/2005 Ward ..... A63B 21/4021 482/93
2006/0038455 A1 * 2/2006 Pavwoski ..... A63B 21/0004 310/120
2006/0183609 A1 * 8/2006 Flynn ..... A63B 21/0004 482/124
2006/0247102 A1 * 11/2006 Kupferman ..... A63B 21/0004 482/44
2007/0010380 A1 * 1/2007 Wilkinson ..... A63B 21/0004 482/124
2008/0261788 A1 * 10/2008 Blount ..... A63B 21/4019 482/139
2010/0222189 A1 * 9/2010 Washington ..... A63B 21/0552 482/124
2010/0311546 A1 * 12/2010 Kupferman ..... A63B 21/0004 482/47
2011/0045953 A1 * 2/2011 Poli ..... A63B 21/023 482/48
2011/0059829 A1 3/2011 Hetrick
2011/0301001 A1 * 12/2011 Hopper ..... A63B 21/0552 482/121
2012/0214651 A1 8/2012 Ross
2012/0220436 A1 * 8/2012 Zoltak ..... A63B 21/0552 482/129
2012/0283077 A1 * 11/2012 Cranke ..... A63B 21/0442 482/124
2013/0072829 A1 * 3/2013 Fausti ..... A61H 1/0285 601/40
2013/0143724 A1 6/2013 DeMeo
2014/0171236 A1 * 6/2014 Oravecz ..... A63B 21/00185 473/518
2014/0213420 A1 * 7/2014 Harris ..... A63B 71/14 482/93
2015/0065317 A1 * 3/2015 Washington ..... A63B 21/0442 482/124
2015/0128328 A1 * 5/2015 Harris ..... A41D 19/0037 2/160
2015/0157893 A1 * 6/2015 Canevari ..... A63B 21/4035 482/129
2015/0202514 A1 * 7/2015 Ervin ..... A63B 69/0071 473/450
2016/0001120 A1 * 1/2016 Williams ..... A63B 21/0552 482/126
2016/0101309 A1 * 4/2016 Schreiber ..... A63B 23/03541 482/124
2017/0028244 A1 * 2/2017 Schreiber ..... A63B 21/0557
2017/0028245 A1 * 2/2017 Williams ..... A63B 21/0557
2018/0099200 A1 * 4/2018 Young ..... A63B 69/0059
2018/0140929 A1 * 5/2018 Pellegrino ..... A63B 26/00

* cited by examiner

Computer System 1400

BRACE WITH STRAP DEVICE FOR EXERCISING STABILITY MUSCLES

CROSS-REFERENCE TO RELATED APPLICATIONS

This application claims the benefit of and priority to the provisional patent application Ser. No. 62/475,125, entitled "BRACE WITH STRAP FOR EXERCISING STABILITY MUSCLES," with filing date Mar. 22, 2017, and hereby incorporated by reference in its entirety.

FIELD

Embodiments of the present invention generally relate to the field of physical training. More specifically, embodiments of the present invention relate to equipment for performing physical training exercises to strengthen and develop stability muscles and ligaments.

BACKGROUND

Most physical training regiments involve a series of strength training exercises performed with free-weights (e.g., dumbbells, barbells, etc.) or strength training machines (e.g., weight lifting machines or resistance machines) to develop muscles and increase the strength of the person. Strength training has been shown to increase vascular health, promote bone density, prevent muscle loss, reduce resting blood pressure, improve blood flow, help control blood sugar, improve cholesterol levels, and improve balance and coordination.

Strength training with free-weights enables a full range of motion and places greater demand on stabilizing muscles compared to machine strength training. However, free-weights require using proper skill and technique to avoid injury and prevent unbalanced development of muscle groups. Furthermore, strength training with heavier free-weights may require the use of a spotter to avoid severe injury.

Strength training machines solve many of the problems that may occur when training with free-weights. Examples of strength training machines include pull-down machines (e.g., cables and pulleys), leg press machines, leg extension machines, and pec deck machines. Because the range of motion is inherently limited by the configuration of the strength training machine, the risk of injury is greatly reduced. Strength training machines also do not generally require the assistance of a spotter. However, the lack of freedom of movement when using strength training machines means that stabilizer muscles and tendons are not substantially strengthened or developed during machine strength training.

What is needed is a device that promotes the development of stabilizer muscles which includes ligaments and tendons without increasing the risk of injury or unbalanced development of muscle groups.

SUMMARY

An exercise device is disclosed herein. Embodiments of the present invention are drawn to an exercise device generally having a strap, a brace, and a ring, and is specially designed to assist in the development of stabilizer muscles, ligaments and tendons. The brace includes four finger straps and a thumb strap for looping around and gripping a user's fingers and thumbs, respectively. When the exercise device is used while exercising, force applied to the brace is evenly distributed to stretch and strengthen the user's hands. A key benefit of the exercise device is activating stabilizing muscles of the hands, arms and core stability muscles. This promotes better form and technique during lifting, which translates into stronger more flexible muscle movement and fewer injuries.

According to one embodiment, an exercise equipment is disclosed. The exercise equipment includes a brace, a belt coupled to the brace, and a ring coupled to the belt, where the brace includes individual bands, each band for looping around, and gripping, a respective digit of a hand, where the brace with belt are configured to be inserted through the ring to loop-attach to a resistance device. The brace is operable to transmit force from the resistance device uniformly through the hand and its arm to exercise stability muscles of the body responsive to hand movement.

According to another embodiment, an exercise equipment is disclosed including a brace, a belt coupled to the brace, a ring coupled to the belt, where the brace includes individual bands, each band for looping around, and gripping, a respective digit of a foot, and where the brace with belt are configured to be inserted through the ring to loop-attach to a resistance device. The brace is operable to transmit force from the resistance device uniformly through the foot and its leg to exercise stability muscles of the body responsive to foot movement.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

Reference will now be made in detail to several embodiments. While the subject matter will be described in conjunction with the alternative embodiments, it will be understood that they are not intended to limit the claimed subject matter to these embodiments. On the contrary, the claimed subject matter is intended to cover alternative, modifications, and equivalents, which may be included within the spirit and scope of the claimed subject matter as defined by the appended claims.

Furthermore, in the following detailed description, numerous specific details are set forth in order to provide a thorough understanding of the claimed subject matter. However, it will be recognized by one skilled in the art that embodiments may be practiced without these specific details or with equivalents thereof. In other instances, well-known methods, procedures, components, and circuits have not been described in detail as not to unnecessarily obscure aspects and features of the subject matter.

Brace with Strap Device for Exercising Stability Muscles

Embodiments of the present invention are drawn to an exemplary exercise device generally having a strap, a brace, and a ring. The following discussion describes one such exemplary exercise device.

Figure 1:
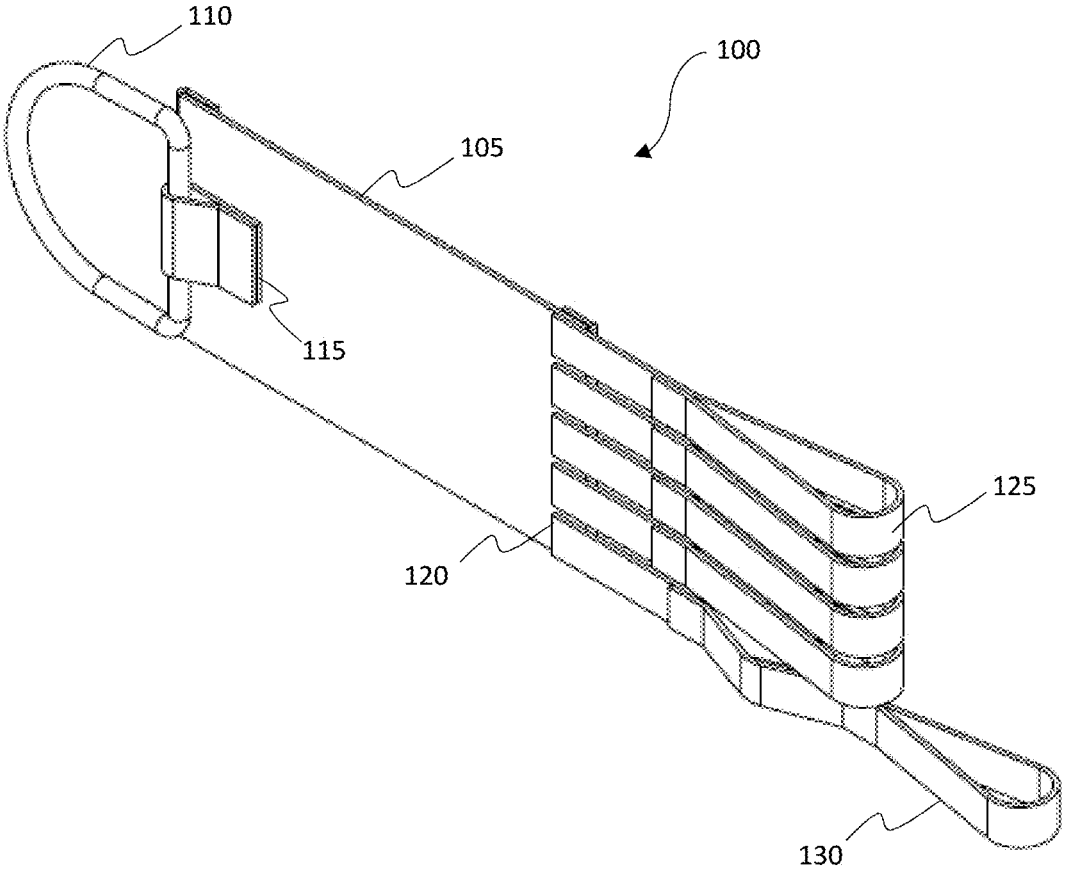
FIG. 1 is a diagram of a perspective view of an exemplary exercise device for exercising stability muscles according to embodiments of the present invention.

With regard to FIG. 1, an exemplary personal exercise device 100 is depicted according to embodiments of the present invention. The exemplary exercise device 100 includes a base strap or belt 105, and is designed for use by one person. One end of the base strap 105 is attached to a ring strap 115, and another end of the base strap 105 is attached to a brace 120. The ring strap 115 wraps around a portion of a ring 110 (e.g., a D-ring) to secure the ring 110 to an end of the base strap 105. In one embodiment, the ring 110 can be made of metal material.

An end of the brace 120 may be inserted through the ring 110 when a free-weight (e.g., dumbbell, barbell, or kettlebell) is placed on the middle of the base strap 105, thereby securing the free-weight to the exercise device 100. The user then places a finger through each loop and is able to lift (palm open and facing upward) the free-weight by applying force to the exercise device 100 while wearing or holding brace 120. For Pilates equipment, a spring or cable can be clipped or otherwise secured to the ring. For stretching, no equipment is necessary; a user can simply place a finger through each loop, grab the base strap with the free hand and pull.

Brace 120 includes four finger straps or bands 125 and a thumb strap or band 130 for looping around and gripping a user's fingers and thumbs, respectively. According to some embodiments, the finger straps are 2-inch loops constructed from 4 4-inch by ½-inch polypropylene rectangles, and a distal end of each loop is heavy-sewn into the middle of each polypropylene rectangle to enhance structural integrity during exercise.

When the exemplary exercise device 100 is used while exercising, force applied to the brace is evenly distributed to stretch and strengthen the user's hands. A key benefit of the exercise device is activating stabilizing muscles of the hands, arms and core stability muscles. This promotes better form and technique during lifting, which translates into the ability to lift smarter, not harder, with greater core stability to avoid injuries. This is especially important for users transitioning from resistance-based strength training equipment to free weights, as their stabilizer muscles have not been used frequently and may be underdeveloped.

The exemplary exercise device 100 can be used in conjunction with a free weight or kettlebell, or other resistance device, such as a fixed-position bar, a resistance band, an adjustable weight, a door or doorframe, a fixed object, a barbell, a dumbbell, or any other object that can be used to provide resistant force. An end of the brace 120 may be inserted through the ring 110 to secure the resistance device to the base strap 105, thereby securing the resistance device to the exercise device 100 for use during exercise.

According to other embodiments, the brace includes individual bands configured to loop around and grip digits of the user's hand. The brace is operable to transmit force from an attached resistance device uniformly through the hand and its arm to exercise stability muscles of the body responsive to hand movement. According to other embodiments, the strap is longer in length, and the brace includes individual bands configured to loop around and grip digits of the user's foot. The brace is operable to transmit force from an attached resistance device uniformly through the foot and its leg to exercise stability muscles of the body responsive to foot movement.

Figure 2A:
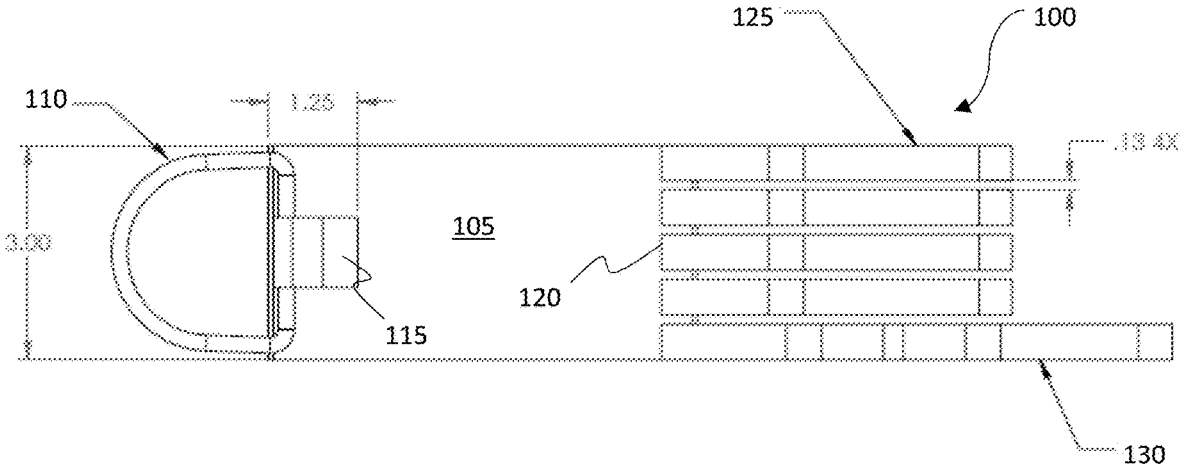
FIG. 2A is a diagram of a top view of an exemplary exercise device for exercising stability muscles according to embodiments of the present invention.
Figure 2B:
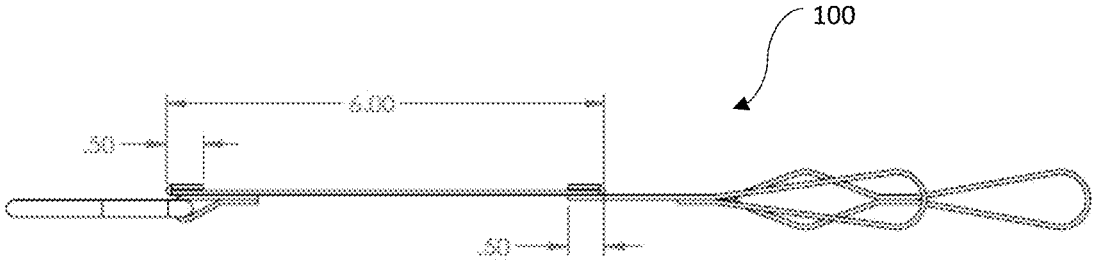
FIG. 2B is a diagram of a side view of an exemplary exercise device for exercising stability muscles according to embodiments of the present invention.

With regard to FIGS. 2A and 2B, a top view and a side view of an exemplary exercise device 100 for exercising stability muscles are depicted, respectively, according to embodiments of the present invention. As depicted in FIG. 2A, according to some embodiments, ring strap 115 is approximately 1.25 inches long, the base strap 105 is approximately 3 inches wide, and the finger straps 125 are spaced approximately 0.13 inches apart, for instance. As depicted in FIG. 2B, according to some embodiments, the base strap 105 is approximately 6 inches long, and ends of the base strap 105 include 0.5 inches of material folded over to improve the structure integrity of the base strap 105 and/or support heavy stitching thereof. The exercise device including the straps can be made of any flexible material of suitable strength, such as plastic, natural fabric (e.g., cloth), synthetic fabric (e.g., nylon), vinyl, rubber, or leather, for example. According to some embodiments, ends of the straps are melted or burned to seal the ends and prevent fraying/wearing. The ends of the straps may be melted using a heat source, such as a flame, hot plate, or laser, for example.

Figure 3A:
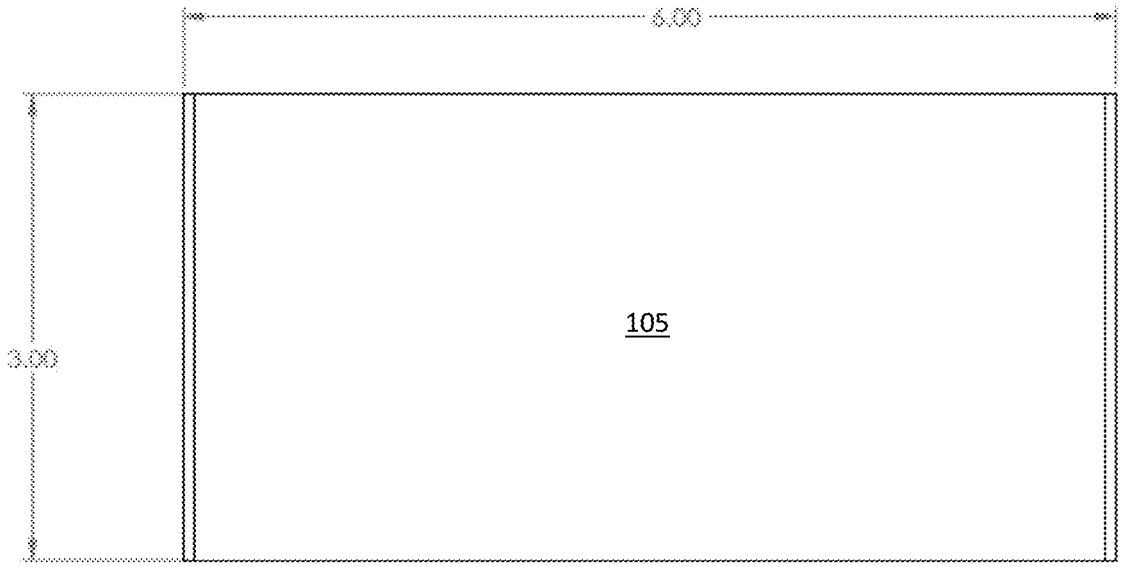
FIG. 3A is a diagram of a top view of an exemplary base strap according to embodiments of the present invention.
Figure 3B:
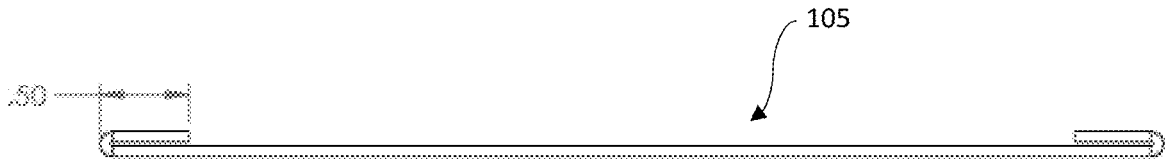
FIG. 3B is a diagram of a side view of an exemplary base strap according to embodiments of the present invention.

With regard to FIGS. 3A and 3B, a top view and a side view of an exemplary base strap 105 are depicted, respectively, according to embodiments of the present invention. According to some embodiments, the base strap includes heavyweight polypropylene main strap capable of withstanding 1,000 pounds of pull.

Figure 4A:
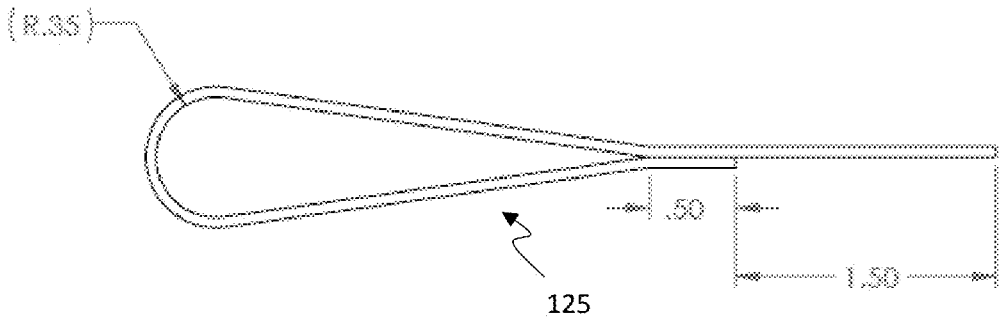
FIG. 4A is a diagram of a top view of an exemplary finger strap of a brace according to embodiments of the present invention.
Figure 4B:
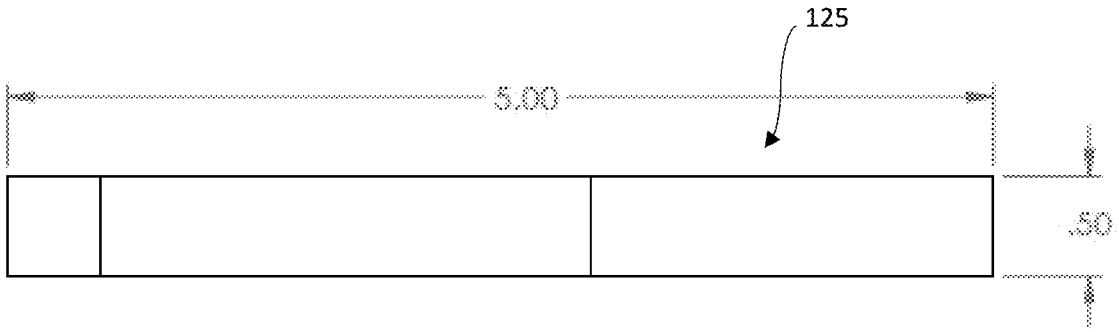
FIG. 4B is a diagram of a side view of an exemplary finger strap of a brace according to embodiments of the present invention.

With regard to FIGS. 4A and 4B, a side view and a top view of an exemplary finger strap 125 are depicted, respectively, according to embodiments of the present invention. As depicted in FIG. 4A, according to some embodiments, finger strap 125 includes a flat portion approximately 1.5 inches in length, a loop portion having a radius of approximately 0.35 inches, and a connecting portion roughly 0.5 inches in length, where the connecting portion is coupled to the flat portion using heavy stitches, for example. As depicted in FIG. 4B, according to some embodiments, the total length of finger strap 125 is approximately 5 inches, and the width of finger strap 125 is approximately 0.5 inches. These dimensions are exemplary only.

Figure 5A:
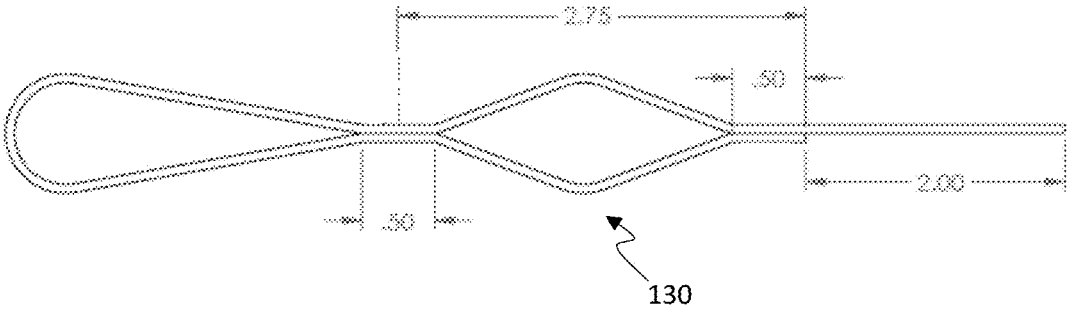
FIG. 5A is a diagram of a top view of an exemplary thumb strap of a brace according to embodiments of the present invention.
Figure 5B:
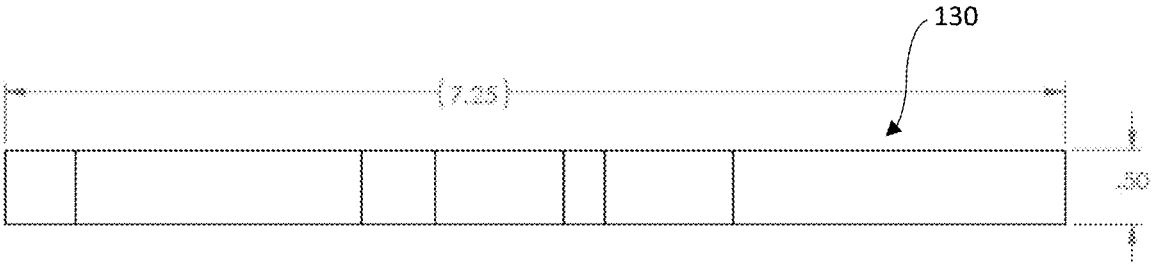
FIG. 5B is a diagram of a side view of an exemplary thumb strap of a brace according to embodiments of the present invention.

With regard to FIGS. 5A and 5B, a side view and a top view of an exemplary thumb strap 130 are depicted, respectively, according to embodiments of the present invention. As depicted in FIG. 5A, according to some embodiments, thumb strap 130 includes a flat portion that is approximately 2 inches long, an interior loop that is approximately 2.75 inches long, and an exterior loop that is approximately 2.5 inches long. According to some embodiments, connecting portions on either side of the interior loop are approximately 0.5 inches long, where the connecting portions are coupled to other portions of base strap 105 using heavy stitches, for example. These dimensions are exemplary only. In one embodiment, the exterior loop of the thumb strap 130 is a first sub-band and the interior loop is a second sub-band. The first sub-band is coupled to the second sub-band. As will be described hereinafter, the first sub-band is configured for gripping the thumb of the hand when the hand motion is a pull motion and the second sub-band is configured for gripping the thumb when said hand motion is a push motion.

Figure 6A:
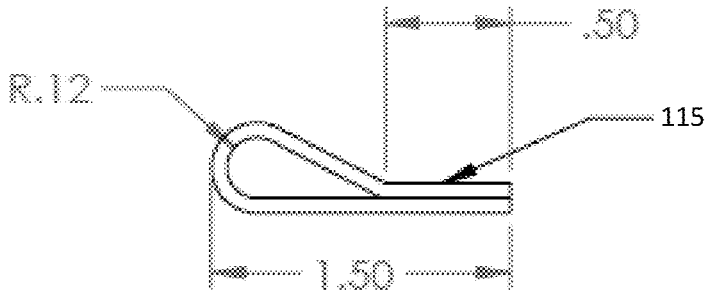
FIG. 6A is a diagram of a top view of an exemplary ring strap used to secure the base strap according to embodiments of the present invention.
Figure 6B:
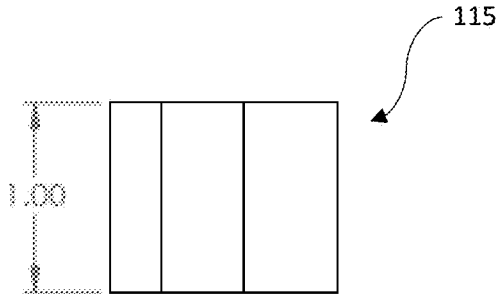
FIG. 6B is a diagram of a side view of an exemplary ring strap used to secure the base strap according to embodiments of the present invention.

With regard to FIGS. 6A and 6B, a side view and a top view of an exemplary ring strap 115 for securing a base strap to a ring are depicted, respectively, according to embodiments of the present invention. As depicted in FIG. 6A, according to some embodiments, ring strap 115 is approximately 1.5 inches in length, includes a loop having a radius of approximately 0.12 inches, and a flat portion that is approximately 0.5 inches and length, where the flat portion is connected to another portion of ring strap 115 using heavy stitches, for example. These dimensions are exemplary only.

With regard to FIGS. 7 through 10, exemplary strength training exercises using exercise devices having braces and straps for strengthening stabilizer muscles are depicted according to embodiments of the present invention. The exercise devices are worn or held by the user by looping a brace of the device around the user's hands. More specifically, each of the user's fingers are inserted into a respective finger strap of the brace, and each of the user's thumbs are inserted into a thumb strap of the brace. For weight training, a strap, connected to the brace, is wrapped around a free-weight (e.g., a dumbbell) or other resistance device and inserted through a ring to secure the strap to the free-weight.

Figure 7:
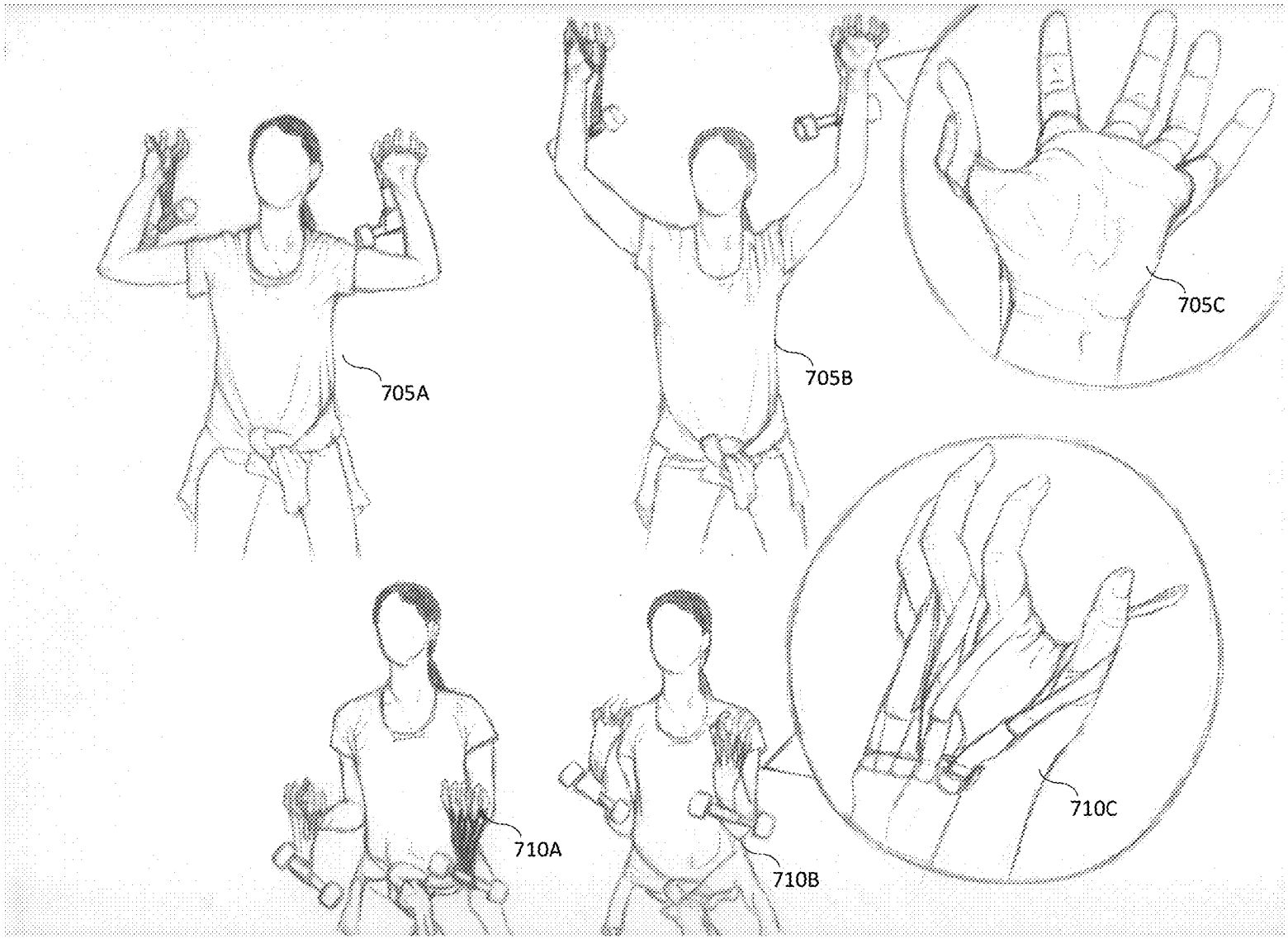
FIG. 7 is a diagram of exemplary strength training exercises, including shoulder presses and bicep curls, performed using an exemplary brace and strap for strengthening stabilizer muscles according to embodiments of the present invention.

As depicted in FIG. 7, a shoulder press exercise using an exemplary exercise device according to embodiments of the present invention begins at starting position 705A, where the user's hands are roughly even with the user's head, palm open and upward as shown, 705C. To reach ending position 705B, the user lifts their hands above their head by applying an upward force to the harness. In this example, a barbell is used as the weight. In turn, the force experienced by the user's hand 705C is evenly distributed among the user's fingers and thumb. In this way, the downward force experienced by the user's hands strengthens and stretches the hands, and further, strengthens associated stabilizer muscles.

An arm or bicep curl exercise using an exemplary exercise device according to embodiments of the present invention begins at starting position 710A, where the user's palms are facing upwards, and the user's arms are roughly bent at 90 degrees. To reach ending position 710B, the user curls their arms upward while keeping their elbows roughly stationary. Again, a barbell is shown as the weight. The harness allows the force generated by the user to be distributed evenly throughout the user's hand 710C, thereby strengthening and stretching the hands, and further, strengthening associated stabilizer muscles.

Figure 8:
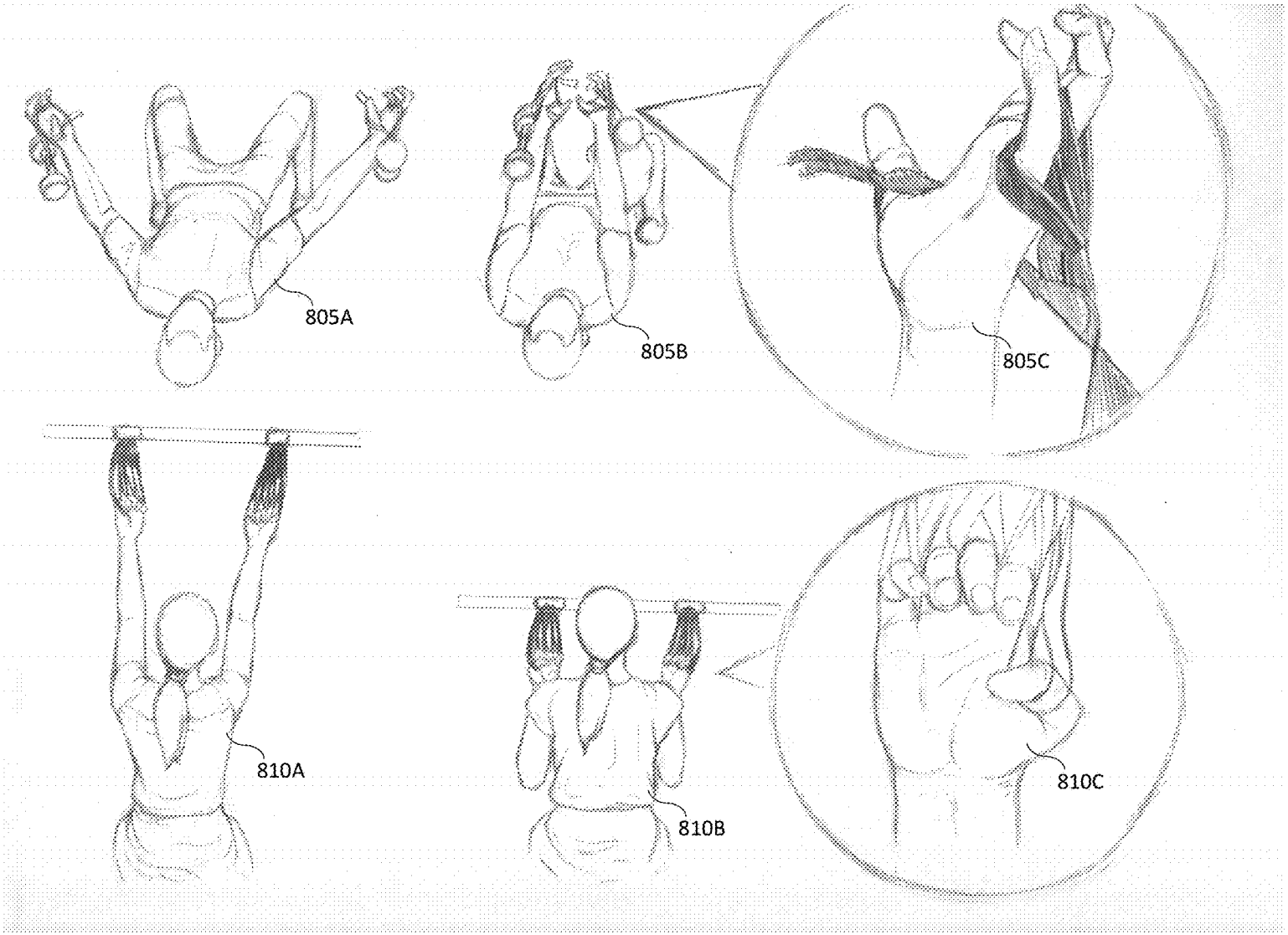
FIG. 8 is a diagram of exemplary strength training exercises, including pectoral flies and pull-ups, performed using an exemplary brace and strap for strengthening stabilizer muscles according to embodiments of the present invention.

As depicted in FIG. 8, a chest or pectoral fly exercise using an exemplary exercise device according to embodiments of the present invention begins at starting position 805A, where the user's arms are stretched outward laterally. To reach ending position 805B, the user lifts the resistance device (e.g., dumbbells) by brings his hands close together while maintaining arm straightness. The harness allows the force generated by the user to be distributed evenly throughout the user's hand 805C, thereby strengthening and stretching the hands, and further, strengthening associated stabilizer muscles. When the user performs the chest or pectoral fly exercise to lift the resistance device, the thumb of the hand can be gripped in the interior loop or second sub-band of the exercise device to perform the push motion.

A pull-up exercise using an exemplary exercise device according to embodiments of the present invention begins at starting position 810A, where the user's arms are maximally stretched while the user hangs from an exemplary exercise device wrapped around and secured to a fixed horizontal bar. To reach ending position 810B, the user grasps the harness and pulls themselves upwards towards the horizontal fixed-position bar. The harness allows the force generated by the user to be distributed evenly throughout the user's hand 810C, thereby strengthening and stretching the hands, and further, strengthening associated stabilizer muscles. When the user performs a pull-up exercise using the exercise device to pull towards the horizontal fixed-position bar, the thumb of the hand can be gripped in the exterior loop or first sub-band to perform the pull motion.

Figure 9:
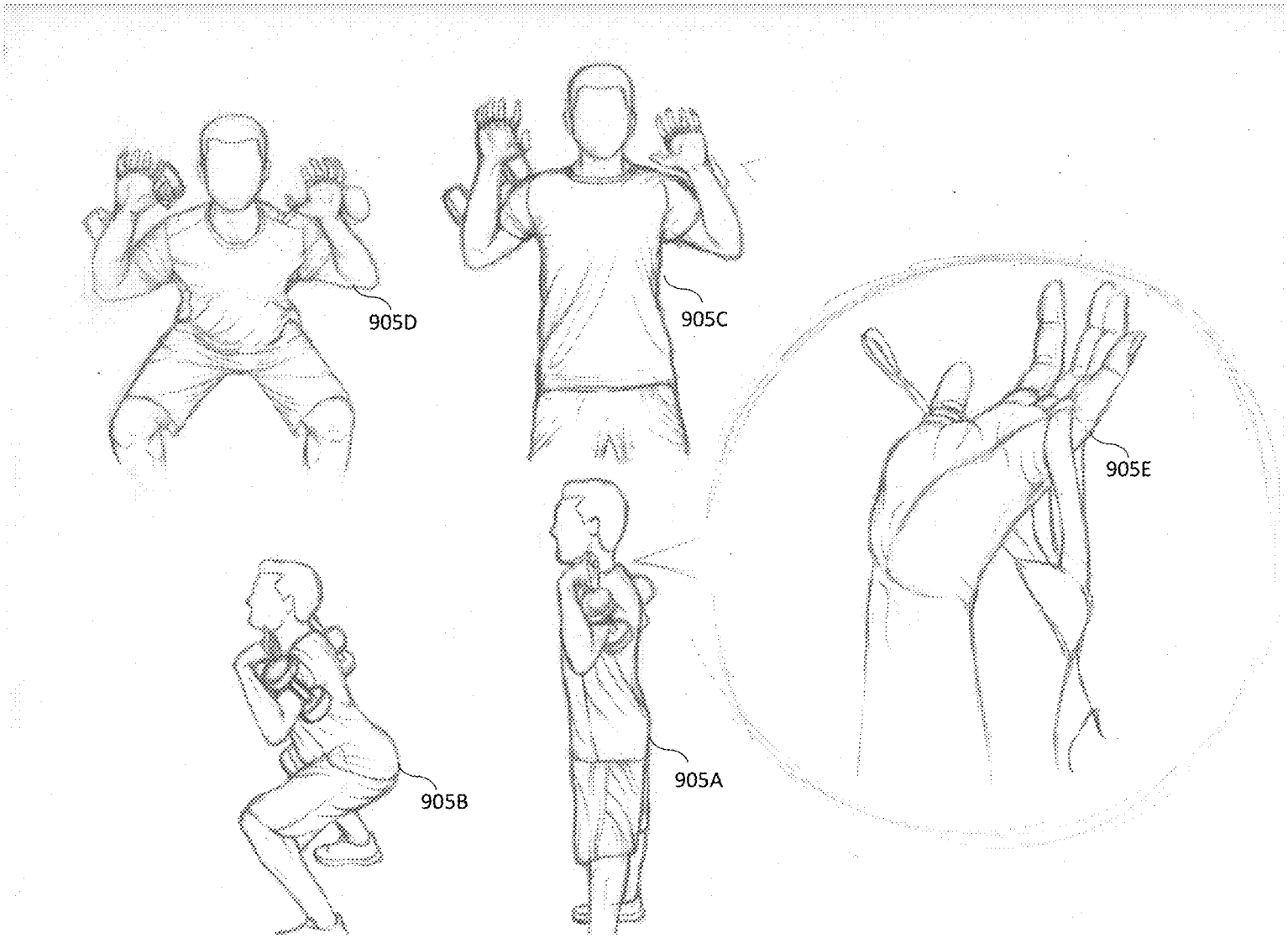
FIG. 9 is a diagram of exemplary strength training exercises, including front squats, performed using an exemplary brace and strap for strengthening stabilizer muscles according to embodiments of the present invention.

With regard to FIG. 9, a squat exercise (e.g., a front squat) using exemplary exercise devices and resistance devices according to embodiments of the present invention begins at starting position 905A/905C, where the user is standing straight with both hands raised near shoulder level. A pair of dumbbells are used as resistance devices. To reach ending position 905B/905D, the user squats down while maintaining a flat back (e.g., without bending forward). The harness of the exercise device allows force generated by the user to be distributed evenly throughout the user's hand 905E, thereby strengthening and stretching the hands, and further, strengthening associated stabilizer muscles. In this way, a greater amount of weight can be used during squat exercises without substantially increasing the risk of injury.

As depicted in FIG. 9, squat exercises may be performed using dumbbells secured to an exemplary exercise device for each hand of the user, where the exemplary exercise devices evenly distribute the force generated by the user throughout the user's hand 905E. Alternatively, squat exercises may be performed using a single barbell or kettlebell, for example, where two exemplary exercise devices (one for each hand) are attached to the same resistance device. In this situation, both hands perform the exercise at the same time instead of alternating sides.

Figure 10:
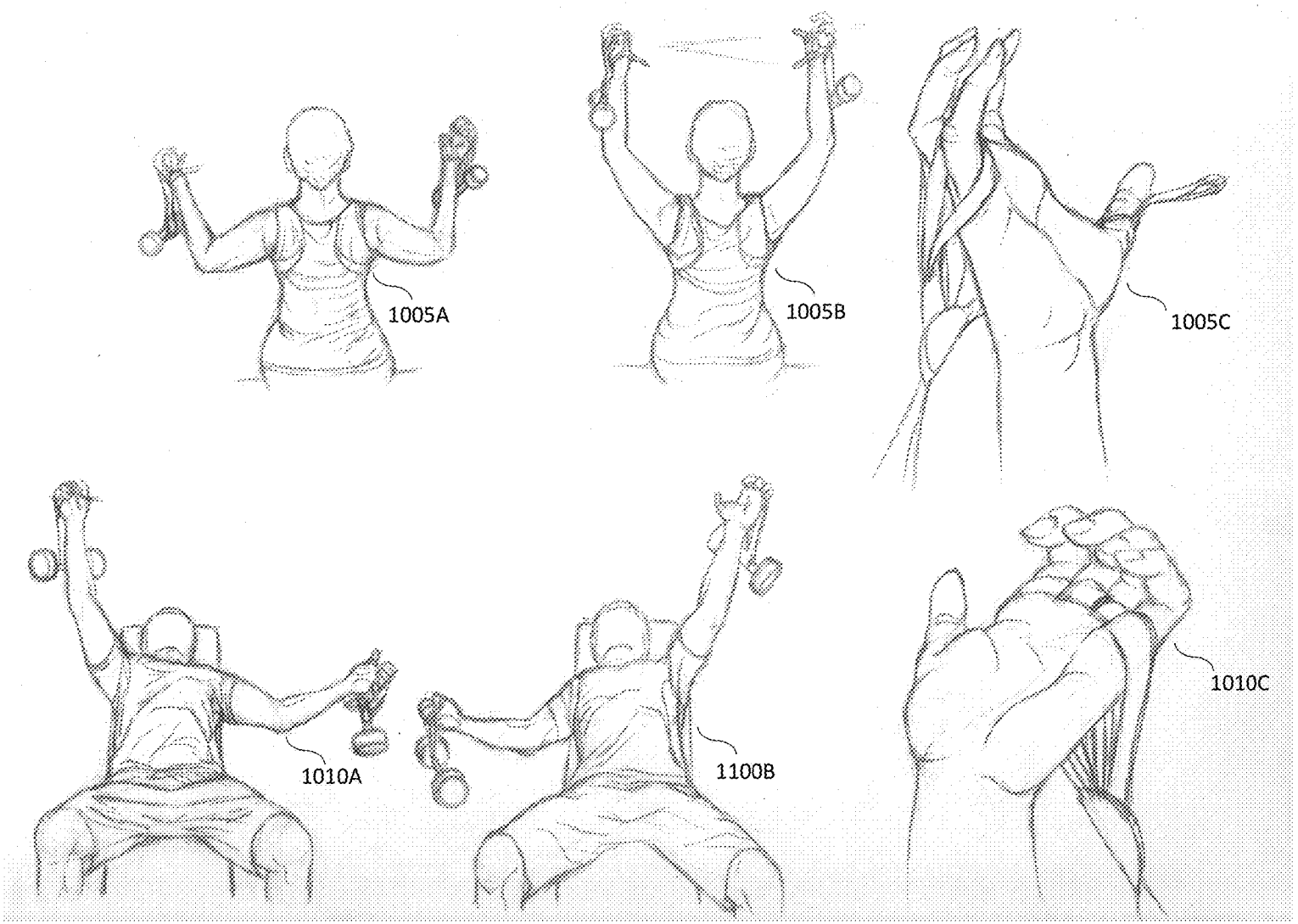
FIG. 10 is a diagram of exemplary strength training exercises, including seated shoulder presses and one-handed chest presses, performed using an exemplary brace and strap for strengthening stabilizer muscles according to embodiments of the present invention.

As depicted in FIG. 10, a seated shoulder press exercise using an exemplary exercise device according to embodiments of the present invention begins at starting position 1005A, where the user's hands are roughly even with the user's head. A pair of dumbbells are used as resistance devices. To reach ending position 1005B, the user lifts their hands above their head by applying an upward force to the harness of the exercise device. In turn, the force experienced by the user's hand 1005C is evenly distributed among the user's fingers and thumb. In this way, the downward force experienced by the user's hands strengthens and stretches the hands, and further, strengthens associated stabilizer muscles.

A one-handed chest press exercise using an exemplary exercise device according to embodiments of the present invention begins at starts at a resting position with both arms lowered. A pair of dumbbells are used as resistance devices. The user then raises one arm to a near lock-out position 1010A. That arm is lowered and the other arm is raised in alternating fashion, as depicted in position 1010B. The harness of the exercise device allows the force generated by the user to be distributed evenly throughout the user's hand 1010C, thereby strengthening and stretching the hands, and further, strengthening associated stabilizer muscles.

Figure 11:
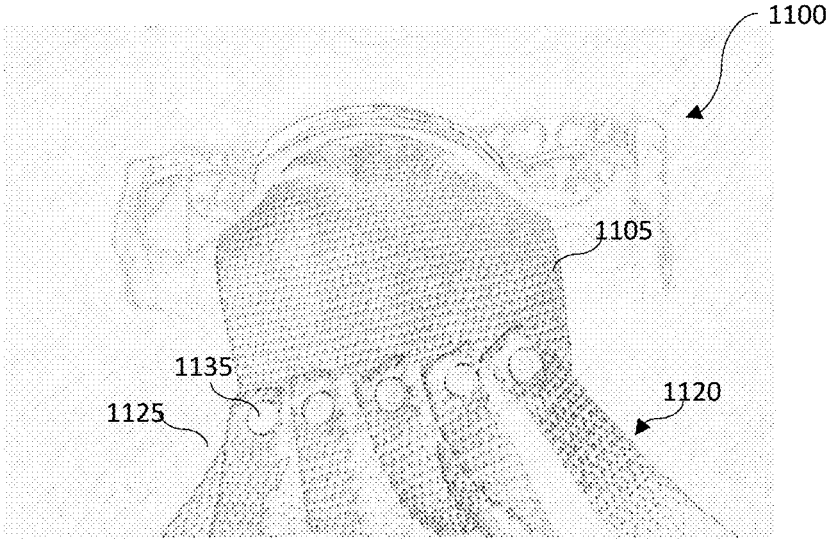
FIG. 11 is a diagram of an exemplary personal exercise device with rivets depicted according to embodiments of the present invention.

With regard to FIG. 11, an exemplary personal exercise device 1100 with rivets is depicted according to embodiments of the present invention. Similar to person exercise device 100 depicted in FIG. 1, the personal exercise device 1100 includes a brace 1120, and force applied to the brace 1120 is evenly distributed to stretch and strengthen the user's hands. The personal exercise device 1100 includes rivets 1135 disposed near the ends of the finger straps 1125 of brace 1120 for securing the finger straps 1125 to the strap 1105 of the exercise device 1100.

Still with regard to FIG. 11, according to some embodiments, the rivets 1135 are sensors operable to detect the motion and/or force applied to the exercise device 1100 by the user's hand. According to some embodiments, the exercise device 1100 further includes an accelerometer operable to measure or detect motion of the user during exercise. A software application may be provided for receiving data from the sensors and/or accelerometer of the exercise device. For example, the software application can receive force and motion data from the sensors, and determine if the force is applied by the user is substantially even across the plurality of sensors. In this way, the software application can ensure that the exercise device 1100 is being used in an optimal manner, where the force applied by the user is evenly distributed across the user's fingers.

Figure 12:
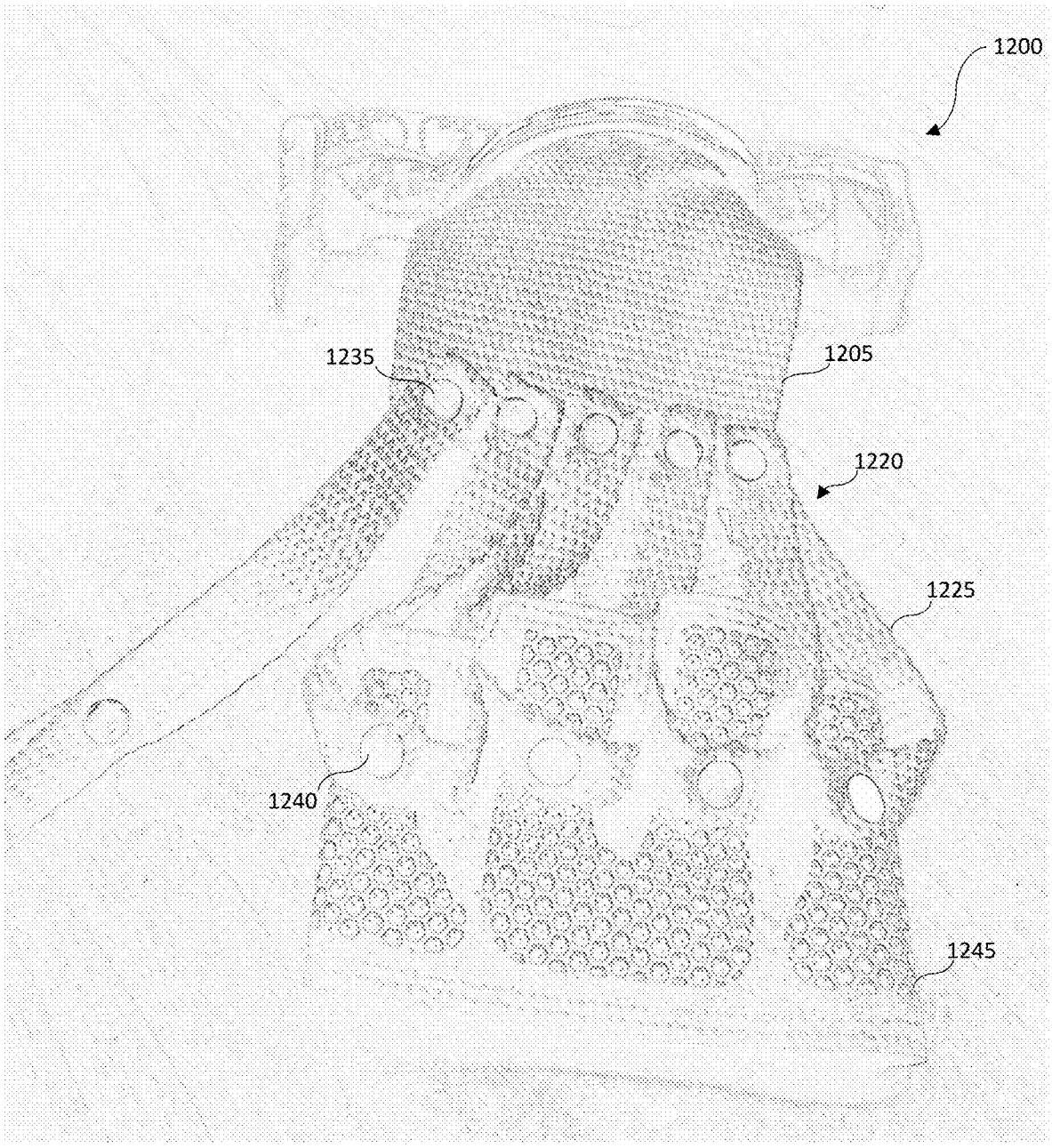
FIG. 12 is a diagram of an exemplary personal exercise device with rivets and a glovelet depicted according to embodiments of the present invention.

With regard to FIG. 12, an exemplary personal exercise device with rivets and a glovelet is depicted according to embodiments of the present invention. Similar to person exercise device 1100 depicted in FIG. 11, the personal exercise device 1200 includes a brace 1220, and force applied to the brace 1220 is evenly distributed to stretch and strengthen the user's hands. The personal exercise device 1200 includes rivets 1235 disposed near the ends of the finger straps 1225 of brace 1220 for securing the finger straps 1225 to the strap 1205 of the exercise device 1200. A second set of rivets 1240 is used to secure the opposite ends of the finger straps to glovelet 1245.

Glovelet 1245 includes divided cavities or loops for inserting fingers, and the user performs exercises while their fingers are inserted into the glovelet 1245. In this way, the glovelet 1245 can enhance the user's comfort while exercising and help ensure that the force applied by the user is evenly distributed across the user's fingers. The glovelet 1245 may be made from nylon, for example, or any material that is relatively strong and flexible, such as plastic, rubber, cloth, leather, etc. According to some embodiments, the rivets 1240 are sensors operable to detect the motion and/or force applied to the exercise device 1100 by the user's hand.

Figure 13:
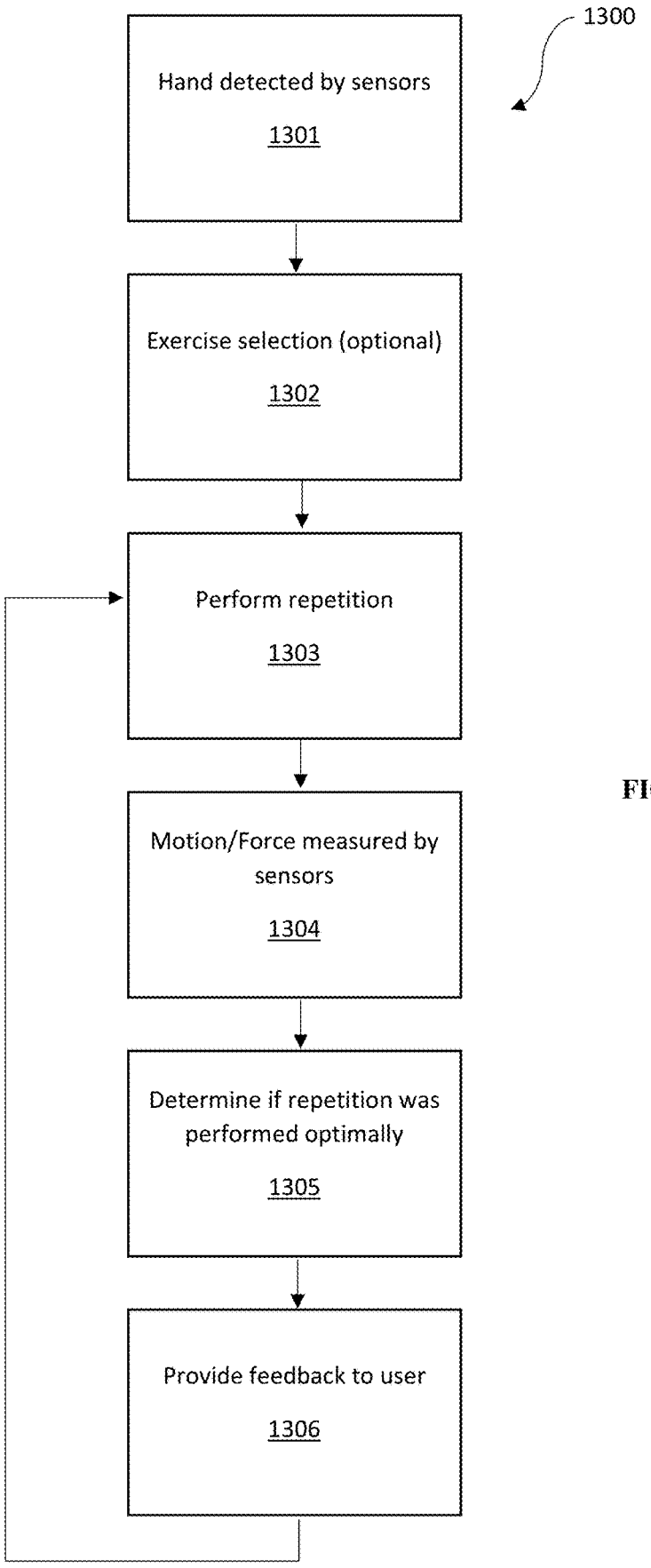
FIG. 13 is a flowchart depicting an exemplary sequence of computer implemented steps for detecting an optimal weight distribution during exercise depicted according to embodiments of the present invention.

With regard to FIG. 13, a flow chart depicting an exemplary sequence of computer implemented steps 1300 for detecting an optimal weight distribution during exercise is depicted according to embodiments of the present invention. The steps are performed using a personal exercise having sensors, and a software application executed on a computer system (e.g., exemplary computer system 1412) receives data from the sensors and provides feedback to the user. The sensors of the personal exercise device may communicate with the software application using radio frequency (RF) technology, Wi-Fi, Bluetooth, or any other wireless communication technology.

At step 1301, the sensors of the exercise device detect the presence of a user's hand. The detecting may be accomplished using capacitive sensing between the user's hand and the sensors. At step 1302, according to some embodiments, an exercise is entered or selected to configure the software application. At step 1303, the user performs a first exercise repetition. At step 1304, the sensors provide force and/or motion feedback to the software applications. According to some embodiments, the sensors include an accelerometer for measuring acceleration of the exercise device. At step 1305, the software application determines if the first repetition was optimally performed.

According to some embodiments, determining if the first repetition was optimally performed includes determining a difference between the force measured by each sensor. If the difference in forces is below a predetermined threshold, the repetition is considered optimal. At step 1306, the software application provides feedback to the user. The process 1300 returns to step 1303 and repeats for a second repetition. According to some embodiments, the feedback indicates if the repetition was optimally performed. According to some embodiments, the feedback indicates the difference in force measured by the sensors, and instructs the user to exert more or less force using specific fingers. According to some embodiments, the software application keeps a count of the number of repetitions that are performed optimally.

Figure 14:
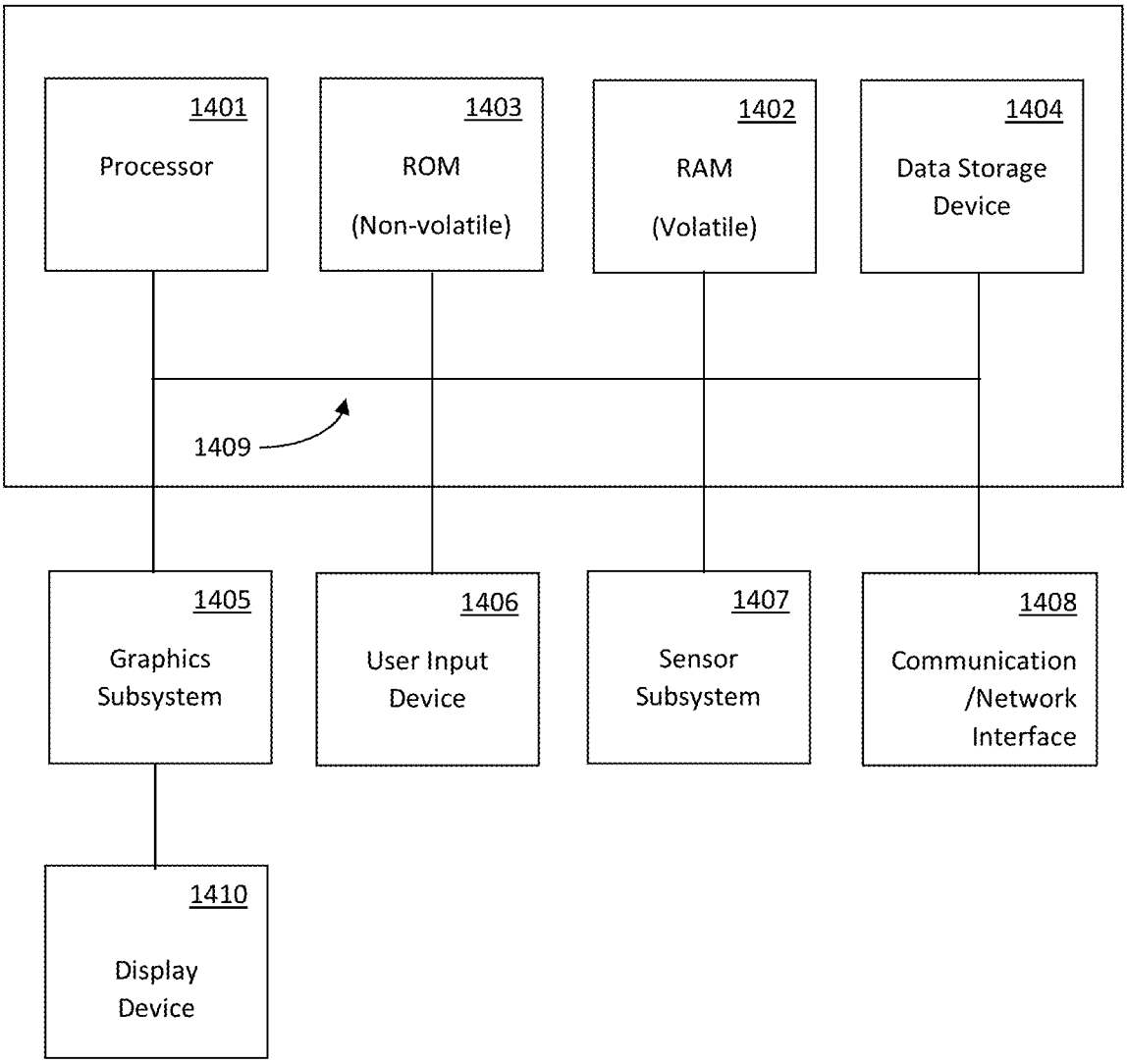
FIG. 14 is a block diagram of an exemplary computer system upon which embodiments of the present invention may be implemented.

As depicted in FIG. 14, embodiments of the present invention may be implemented using an exemplary system 1400. In a basic configuration, computing system 1400 typically includes at least one processing unit 1401 and memory, and an address/data bus 1409 (or other interface) for communicating information. Depending on the exact configuration and type of computing system environment, memory may be volatile (such as RAM 1402), non-volatile (such as ROM 1403, flash memory, etc.) or some combination of the two.

Computer system 1400 may also comprise an optional graphics subsystem 1405 for presenting information to the computer user, e.g., by displaying information on a display device 1410. In one embodiment, the processing and image enhancement of the image data received may be performed, in whole or in part, by graphics subsystem 1405 in conjunction with the processor 1401 and memory 1402, with any resulting output displayed on display device 1410. Computer system 1400 may be a personal computer, such as a desktop or laptop computer, or a mobile computing device, such as a smartphone or tablet, for example.

Additionally, computing system 1400 may also have additional features/functionality. For example, computing system 1400 may also include additional storage (removable and/or non-removable) including, but not limited to, magnetic or optical disks or tape. Such additional storage is illustrated in FIG. 14 by data storage device 1407. Computer storage media includes volatile and nonvolatile, removable and non-removable media implemented in any method or technology for storage of information such as computer readable instructions, data structures, program modules or other data. RAM 1402, ROM 1403, and data storage device 1407 are all examples of computer storage media.

Computer system 1400 also comprises an optional alphanumeric input device 1406, an optional cursor control or directing device 1407, and one or more signal communication interfaces (input/output devices, e.g., a network interface card) 1409. Optional alphanumeric input device 1406 can communicate information and command selections to central processor 1401. Optional cursor control or directing device 1407 is coupled to bus 1409 for communicating user input information and command selections to central processor 1401. Signal communication interface (input/output device) 1409, also coupled to bus 1409, can be a serial port. Communication interface 1409 may also include wireless communication mechanisms. Using communication interface 1409, computer system 1400 can be communicatively coupled to other computer systems over a communication network such as the Internet or an intranet (e.g., a local area network), or can receive data (e.g., a digital television signal).

Embodiments of the present invention are thus described. While the present invention has been described in particular embodiments, it should be appreciated that the present invention should not be construed as limited by such embodiments, but rather construed according to the following claims.

What is claimed is:

1. An exercise equipment comprising:

a brace;

a belt stitched to said brace; and an attachment device coupled to said belt, wherein said brace comprises individual bands, each band for looping around, and gripping, a respective digit of a hand, wherein said attachment device is operable to secure a resistance device and wherein said brace is operable to transmit force from said resistance device uniformly through said hand and its arm to exercise stability muscles of the body responsive to hand movement, wherein one of said individual bands comprises a first sub-band coupled to a second sub-band, said first sub-band for gripping a digit of said hand when said hand motion is a pull motion and said second sub-band for gripping a digit when said hand motion is a push motion.

2. An exercise equipment as described in claim 1 wherein said resistance device is a weight.

3. An exercise equipment as described in claim 1 wherein said resistance device is a fixed horizontal object.

4. An exercise equipment as described in claim 1 wherein said resistance device is a barbell.

5. An exercise equipment as described in claim 1 wherein said brace and belt comprise flexible material.

6. An exercise equipment as described in claim 1 wherein said brace and belt comprise flexible vinyl strap material.

7. An exercise equipment as described in claim 1 wherein said stability muscles comprise tendons.

8. An exercise equipment as described in claim 1 wherein said attachment device comprises a metal ring.

9. An exercise equipment as described in claim 1 wherein said belt is approximately six inches long and three inches wide.

10. An exercise equipment as described in claim 1 wherein said brace and said belt are configured to be inserted through said attachment device to secure said resistance device.

11. An exercise device as described in claim 1 wherein said digit is a thumb.

12. An exercise device comprising:

a belt comprising an attachment device disposed at a first end of the belt;

a plurality of bands disposed at a second end of the belt, wherein:

said plurality of bands are configured to secure digits of a hand to the belt, said belt is configured to support a free-weight coupled by the attachment device, and said belt and said plurality of bands are operable to lift said free-weight by transferring a respective force uniformly through said hand and its arm to exercise stability muscles of the body responsive to hand movement lifting said free-weight; and a brace comprising said plurality of bands, wherein said brace is stitched to said belt, wherein one of said plurality of bands comprises a first sub-band coupled to a second sub-band, said first sub-band for gripping a digit of said hand when said hand motion is a pull motion and said second sub-band for gripping a digit when said hand motion is a push motion.

13. An exercise device as described in claim 12 wherein said free-weight comprises at least one of: a dumbbell; a barbell; a kettlebell; and an adjustable weight.

14. An exercise device as described in claim 12 wherein said belt and said plurality of bands comprise flexible material.

15. An exercise device as described in claim 12 wherein said belt and said plurality of bands comprise flexible vinyl strap material.

16. An exercise device as described in claim 12 wherein said stability muscles comprise tendons.

17. An exercise device as described in claim 12 wherein said attachment device comprises a ring.

18. An exercise device as described in claim 12 wherein said digit is a thumb.

* * * * *